US009869178B2

(12) United States Patent
Qin et al.

(10) Patent No.: US 9,869,178 B2
(45) Date of Patent: Jan. 16, 2018

(54) METHOD FOR EFFICIENTLY TREATING SPONTANEOUS IGNITION OF REMAINING COAL IN LARGE AREA GOAF OF SHALLOW-BURIED COAL BED

(71) Applicant: CHINA UNIVERSITY OF MINING AND TECHNOLOGY, Jiangsu (CN)

(72) Inventors: Botao Qin, Jiangsu (CN); Xiaowen Qin, Jiangsu (CN); Xiaoxing Zhong, Jiangsu (CN); Yi Lu, Jiangsu (CN)

(73) Assignee: CHINA UNIVERSITY OF MINING AND TECHNOLOGY (CN)

( * ) Notice: Subject to any disclaimer, the term of this patent is extended or adjusted under 35 U.S.C. 154(b) by 0 days.

(21) Appl. No.: 15/310,394

(22) PCT Filed: Aug. 11, 2015

(86) PCT No.: PCT/CN2015/086604

§ 371 (c)(1),
(2) Date: Nov. 10, 2016

(87) PCT Pub. No.: WO2016/090937

PCT Pub. Date: Jun. 16, 2016

(65) Prior Publication Data

US 2017/0268338 A1 Sep. 21, 2017

(30) Foreign Application Priority Data

Dec. 12, 2014 (CN) ..... 2014 1 0769236

(51) Int. Cl.
*A62C 2/00* (2006.01)
*E21F 5/18* (2006.01)
(Continued)

(52) U.S. Cl.
CPC ..... *E21F 5/18* (2013.01); *A62C 3/00* (2013.01); *A62C 31/22* (2013.01); *A62C 35/023* (2013.01);
(Continued)

(58) Field of Classification Search
CPC ..... A62C 99/009; A62C 99/0009; A62C 99/0018; A62C 3/00; A62C 31/22;
(Continued)

(56) References Cited

U.S. PATENT DOCUMENTS 3,990,517 A * 11/1976 Lewer ..... E21F 5/18 169/45
4,641,711 A * 2/1987 Terry ..... A62C 3/02 169/64
(Continued)

FOREIGN PATENT DOCUMENTS

CN 202031627 11/2011 ..... E21F 5/00
CN 102809394 12/2012 ..... G01F 1/86
(Continued)

OTHER PUBLICATIONS

International Search Report (w/translation) and Written Opinion (w/o translation) issued in application No. PCT/CN2015/086604, dated Nov. 17, 2015 (10 pgs).

*Primary Examiner* — Steven J Ganey
(74) *Attorney, Agent, or Firm* — Hayes Soloway P.C.

(57) ABSTRACT

A method for efficiently treating spontaneous ignition of the remaining coal in a large area goaf of a shallow-buried coal bed, which method integrates leaking stoppage, airflow control and fast inerting and cooling so as to efficiently prevent and treat the spontaneous ignition of the remaining coal in the large area goaf of the shallow-buried coal bed.

12 Claims, 2 Drawing Sheets

(51) Int. Cl.

| | |
|---|---|
| ***E21F 15/00*** | (2006.01) |
| ***A62C 99/00*** | (2010.01) |
| ***A62C 35/02*** | (2006.01) |
| ***A62C 31/22*** | (2006.01) |
| ***E21F 5/00*** | (2006.01) |
| ***A62C 3/00*** | (2006.01) |

(52) U.S. Cl.
CPC ..... *A62C 99/009* (2013.01); *A62C 99/0009* (2013.01); *A62C 99/0018* (2013.01); *E21F 5/00* (2013.01); *E21F 15/005* (2013.01)

(58) Field of Classification Search
CPC .. A62C 35/023; E21F 5/00; E21F 5/18; E21F 15/005
USPC ..... 169/43, 44, 45, 46, 47, 64, 70, 9, 11; 299/12
See application file for complete search history.

(56) References Cited

U.S. PATENT DOCUMENTS

| | | | | |
|---|---|---|---|---|
| 7,334,644 | B1 * | 2/2008 | Ozment | A62C 2/06 169/64 |
| 8,096,622 | B2 * | 1/2012 | Hussey | A62C 3/00 299/12 |
| 8,397,829 | B2 * | 3/2013 | Brown | A62C 3/02 169/46 |
| 8,770,306 | B2 * | 7/2014 | Ide | E21B 43/166 169/46 |

FOREIGN PATENT DOCUMENTS

| | | | |
|---|---|---|---|
| CN | 103133027 | 6/2013 | E21F 5/00 |
| CN | 104514577 | 4/2015 | E21F 5/00 |
| JP | 2000096039 | 4/2000 | C09K 3/22 |

* cited by examiner

METHOD FOR EFFICIENTLY TREATING SPONTANEOUS IGNITION OF REMAINING COAL IN LARGE AREA GOAF OF SHALLOW-BURIED COAL BED

FIELD OF THE INVENTION

The present invention relates to a method for preventing and treating spontaneous ignition of coal, particularly to a method for efficiently treating spontaneous ignition of remaining coal in a large-area goaf of a shallow-buried coal seam.

BACKGROUND OF THE INVENTION

In the "12$^{th}$ Five Year Plan" period of China, the development strategy of the coal industry in China is "Controlling in the Eastern China Region, Stabilizing in the Central China Region, and Vigorously Developing in the Western China Region". In the Western China region, the Country will vigorously propel the construction of large-size coal bases, especially the construction of a number of 10-million ton large-size modern coal mines. The mine area in the Western China region have abundant coal resources, the coal seams have a high risk of spontaneous ignition and are buried under shallow depths (usually not deeper than 200 m), the spacing between coal seams is smaller and the roof bedrocks are thin, a fully mechanized top coal caving technique is mainly used at the working faces, large-area surface collapse and fissures may occur owing to the mining disturbance, and a large quantity of air leakage passages may be formed between the surface to the goaf; consequently, air leakage from the surface becomes severe, and spontaneous ignition of coal in the goaf frequently occurs; meanwhile, the goafs are connected with each other to form a large-area region, which increases the difficulties in prevention and control of spontaneous ignition of coal in the goafs, which severely impacts safe and efficient mining in the coal mines, and leads to severe economic losses and social influences. According to incomplete statistics, more than 200 spontaneous coal ignition accidents which resulting in closing working faces happened in western mine area in the last 10 years, resulting in direct economic losses equivalent to more than RMB 10 billion.

In worldwide, fire prevention and extinguishment techniques such as grouting, nitrogen injection, foam injection, retardant spraying, gel and composite colloid injection, etc., are usually used to prevent and control spontaneous ignition of coal in the coal mines goafs. With the grouting technique, the grout only flows towards lower lying area in the goaf; consequently, the coverage area is small, the grout cannot be accumulated to higher parts, and a "grooved" phenomenon may occur easily; meanwhile, the working faces in western coal mines have long length, high mining intensity and quick advancing rate, and it is unsuitable to set up a permanent surface grouting system in the coal mines; furthermore, owing to the fact that the western mine areas are short of water and soil, it is difficult to implement conventional grouting. The nitrogen injection technique has been widely employed in many mine areas in the last 10 years, owing to the characteristics of nitrogen, such as inerting burning area and wide diffusion area, etc.; however, the nitrogen tends to escape with the air leakage, and the fire extinguishment and cooling ability of nitrogen are weak; meanwhile, owing to the fact that the coal seams in the western mine area are buried under shallow depths, and the goafs are inter-connected to large area, and communicate with the surface fissures, it is difficult to create closed spaces in the goafs; therefore, conventional nitrogen injection cannot attain the purpose of inerting the goafs quickly. With the foam injection technique, though foam injection overcomes some drawbacks of grouting and nitrogen injection and the foams can be accumulated to higher parts, the flow and diffusion range of foams that are injected at high flow rate and have strong diffusibility is still limited in the large-area goaf with a small slope angle; consequently, the foams still cannot completely and effectively cover the float coal and air-leaking fissures in the large-area goaf. With the retardant spraying technique, the retardant may corrode the downhole equipments and harm physical and mental health of the workers, and the fire prevention and extinguishment effect is not ideal. With the gel and composite colloid injection technique, the gel or colloidal mud has a small flow amount but a high cost, and the diffusion area is small; therefore, gel and composite colloid injection is unsuitable for prevention and control of spontaneous ignition of coal in a large-area goaf.

CONTENTS OF THE INVENTION

The object of the present invention is to provide a method for efficiently treating spontaneous ignition of remaining coal in a large-area goaf of a shallow-buried coal seam, which integrates leaking stoppage and airflow control and rapid inerting and cooling, and is applicable to efficient prevention and control of spontaneous ignition of remaining coal in a large-area goaf of a shallow-buried coal seam.

The object of the present invention is achieved with the following technical solution: A method for efficiently treating spontaneous ignition of remaining coal in a large-area goaf of a shallow-buried coal seam, comprising the following steps: pre-judging whether the remaining coal in the goaf ignites spontaneously; once it is found that the remaining coal in the goaf ignites spontaneously, first, enclosing the high-temperature spontaneous ignition area of the remaining coal in the goaf; then, injecting nitrogen continuously at a high flow into the large-area underground goaf to reduce the oxygen concentration in the goaf; next, using an air pressure-balancing fire prevention and extinguishment technique to reduce the air leakage into the goaf, and releasing sulfur hexafluoride tracer gas at the same time to conduct qualitative analysis on air leakage passages that communicate with the goaf and carrying out leaking stoppage in the air leakage passages; then, using surface fire extinguishing drill holes to carry out treatment and detection, i.e., injecting a fire extinguishing material to treat the spontaneous ignition of the coal in the goaf and utilizing effective drill holes to judge whether the spontaneous ignition of the coal in the goaf is extinguished or not; finally, grouting bodying mortar or high-concentration coal ash slurry into the high-temperature spontaneous ignition area of the coal and the drill holes.

The step of pre-judging whether the remaining coal in the goaf ignites spontaneously or not is implemented by using a downhole bundle tube monitoring system to detect the gasses in the goaf in conjunction with the drill holes communicate with the goaf in the downhole roadways and chromatographic analysis of gas samples taken manually with bladders, wherein, the drill holes are utilized as sampling drill holes, gas extraction drill holes, and water drainage drill holes, and whether the remaining coal in the goaf ignites spontaneously is judged by the volumetric concentrations and concentration changes of gases markers for spontaneous ignition of coal, such as CO, $C_2H_4$, and $C_2H_2$, etc. If the volumetric concentration of CO is high and the concentration thereof increases continuously and largely, and $C_2H_4$ gas appears at the same time, it indicates that the temperature of the spontaneously igniting coal in the goaf at least exceeds 85° C.; if $C_2H_2$ appears, it indicates that the temperature of the spontaneously igniting coal in the goaf at least exceeds 200° C.

The step of enclosing the high-temperature spontaneous ignition area of the remaining coal in the goaf comprises the following steps:

1. judging the distribution of compacted areas, loose areas, and remaining coal in the goaf, in consideration that the spontaneous ignition of coal mainly occurs in loose areas and places where a large quantity of remaining coal exists;
2. judging air leakage streams and air leakage stream routes in the downhole goaf;
3. carrying out simulation study on the rule of migration and distribution of gas markers for spontaneous ignition of coal in the goaf, and enclosing the high-temperature spontaneous ignition area of the remaining coal in the goaf preliminarily in conjunction with steps 1 and 2;
4. drilling temperature measurement drill holes having a diameter of 108 mm from the ground surface after the high-temperature spontaneous ignition area of the remaining coal in the goaf is enclosed preliminarily, utilizing the drill holes to detect and verify the temperatures in the areas adjacent to the ends of the drill holes, and finally determining the approximate scope of spontaneous ignition of the remaining coal in the goaf.

The step of injecting nitrogen into the large-area goaf is implemented by injecting nitrogen at a high flow rate not lower than 2,000 $m^3$/h into the downhole goaf.

The step of using a pressure-balancing fire prevention and extinguishment technique to reduce air leakage into the goaf is implemented by mounting a local ventilator and a damper in a return airway at the working face to increase the resistance in the return airway and decrease the pressure difference between an intake airway and the return airway, and thereby reduce the air leakage from the working face to the goaf. The pressure difference between the working face and the goaf is adjusted according to the situation of spontaneous ignition of the coal, under a principle of ensuring a safe working environment.

The step of releasing sulfur hexafluoride tracer gas for qualitative analysis of air leakage passages that communicate with the goaf and carrying out leakage stoppage is implemented by: first, selecting deep and wide ground surface fissures and releasing sulfur hexafluoride tracer gas into those fissures; then, receiving sulfur hexafluoride at top and bottom corners of the downhole working face and analyzing the receiving time and concentration of sulfur hexafluoride; next, carrying out qualitative analysis on the major ground surface fissures and air leakage passages that communicate with the goaf according to the releasing sites and the receiving result; finally, sealing the air leakage passages with coal ash inorganic cured foams to stop the air leakage through the major fissures.

The step of drilling ground surface fire-extinguishing drill holes for detection and treatment is implemented by: forming the fire-extinguishing drill holes by a drilling machine drilling from the ground surface to the goaf in the coal seam; utilizing the drilled fire-extinguishing drill holes as a temperature measurement drill holes first to carry out temperature measurement; utilizing the drilled fire-extinguishing drill holes as gas sampling drill holes then to carry out gas constitution and concentration analysis; next, judging the situation of spontaneous ignition of the remaining coal adjacent to the ends of the drill holes according to the measured temperature and gas constitution in the drill holes; wherein, the ground surface fire-extinguishing drill holes have a diameter of 108 mm, and the spacing between the drill holes is 10~15 m; after the fire-extinguishing drill holes are drilled, the fire-extinguishing material is injected into the drill holes sequentially starting from the peripheral drill holes first, and then turning to the drill holes in the central high-temperature area gradually; liquid nitrogen or liquid carbon dioxide is injected at a high flow through the ground surface fire-extinguishing drill holes into the high-temperature spontaneous ignition area in the goaf for rapid inerting and cooling; specifically, 10~30 tons of liquid nitrogen or liquid carbon dioxide is injected into each drill hole at each time, and then stop grout and turn to grout adjacent drill holes; the grouting is repeated after a period, wherein, the time interval between grouting cycles is 24 h.

The step of utilizing effective drill holes to judge whether the spontaneous ignition of the remaining coal in the goaf is extinguished or not is implemented by: after 3~5 days from the date when the grouting of the fire-extinguishing material into the fire-extinguishing drill holes is stopped, carrying out sampling by a downhole bundle tube monitoring system and drill holes that communicate with the goaf in downhole roadways and the fire-extinguishing drill holes; analyzing the gas markers for spontaneous ignition of the coal in the goaf, such as CO, $C_2H_4$ and $C_2H_2$, etc., making a judgment comprehensively in conjunction with the temperature measurement in the fire-extinguishing drill holes; if the spontaneous ignition is judged as having been extinguished, finally grouting bodying mortar or high-concentration coal ash slurry into the high-temperature spontaneous ignition area of the remaining coal through the fire-extinguishing drill holes, wherein, the mass ratio of coal ash to water in the coal ash slurry is greater than 1:2.

In the sampling analysis of the gasses in the goaf, if the concentration of $O_2$ is stably below 7%, the concentration of CO is stably below 50~100 ppm, no $C_2H_4$ or $C_2H_2$ appears, and the temperatures in the drill holes are normal temperature, it indicates that the spontaneous ignition of the coal in the goaf has been extinguished.

Beneficial effects: With the above-mentioned technical scheme, once spontaneous ignition of the remaining coal in a large-area goaf occurs, firstly, the location and scope of the spontaneous ignition of the coal in the goaf must be judged, and thereby the area of spontaneous ignition of the coal to be treated can be enclosed; after the area of spontaneous ignition of the coal in the goaf is enclosed, nitrogen is injected continuously at a high flow into the downhole goaf, so as to decrease the oxygen concentration in the goaf and effectively control the development of the spontaneous ignition of the remaining coal in the goaf; at the same time, a pressure-balancing technique is used, on one hand, to reduce the air leakage from the working face into the goaf, on the other hand, to effectively inhibit the gushing of toxic and harmful gasses produced in the spontaneous ignition of the coal from the goaf, and thereby provide safe environmental conditions for the follow-up tire prevention and extinguishing work.

Sulfur hexafluoride tracer gas is released from the ground surface, and then sulfur hexafluoride is received at top and bottom corners of the downhole working face, thereby the major air leakage passages from the ground surface to the large-area goaf is judged qualitatively; then, the air leakage passages are sealed with coal ash inorganic cured foams to reduce air leakage from the ground surface to the goaf, and thereby decrease the oxygen concentration in the large-area goaf and inhibit the development of spontaneous ignition of the remaining coal in the goaf.

Liquid nitrogen or liquid carbon dioxide is injected at a high flow through ground surface fire-extinguishing drill holes, to carry out rapid inerting and cooling for the high-temperature spontaneous ignition area of the coal in the goaf and thereby treat the spontaneous ignition of the coal in the goaf quickly, by sufficiently utilizing the advantages of liquid nitrogen or liquid carbon dioxide in fire extinguishing, including high flow, wide diffusion range, wide inerting range, and rapid fire-extinguishing and cooling speed, etc.

After judging the spontaneous ignition of the coal in the goaf having been extinguished, bodying mortar or high-concentration coal ash slurry is grouted through the fire-extinguishing drill holes, so as to thoroughly seal and fill the loose coal rock mass in the goaf and thereby effectively prevent the remaining coal in the goaf from igniting spontaneously again.

When the above techniques are applied in a coordinated manner, spontaneous ignition of the coal in large-area goafs of shallow-buried coal seams can be treated quickly and efficiently. The present invention provides a key technical support for safe and efficient mining in 10-million tons coal mines in the Western China region.

Advantages of the Invention

The present invention provides a method for efficiently treating spontaneous ignition of remaining coal in a large-area goaf of a shallow-buried coal seam, which is a comprehensive method for prevention and control of spontaneous ignition of coal, incorporating measures including reduction of air leakage to the goaf with a pressure-balancing fire prevention and extinguishment technique, sealing of air leakage fissures and passages with light-weight coal ash inorganic cured foams, rapid inerting and cooling with liquid nitrogen (carbon dioxide), and grouting of bodying mortar or high-concentration coal ash slurry into loose coal rock mass in the goaf. Air leakage stoppage and control and rapid inerting and cooling are applied in a coordinated manner, providing a key technical support for treating spontaneous ignition of the coal in large-area goafs of shallow-buried coal seams. The method overcomes the drawbacks in applying fire prevention and extinguishment techniques solely for prevention and control of spontaneous ignition of the coal in a large-area goaf of a shallow-buried coal seam. In addition, the method is easy to operate, and is a systematic, scientific and efficient method for treating spontaneous ignition of coal, and can be applied widely for treating spontaneous ignition of coal in goafs in the mine fields in the Western China region.

DETAILED DESCRIPTION OF THE EMBODIMENTS

Figure 1:
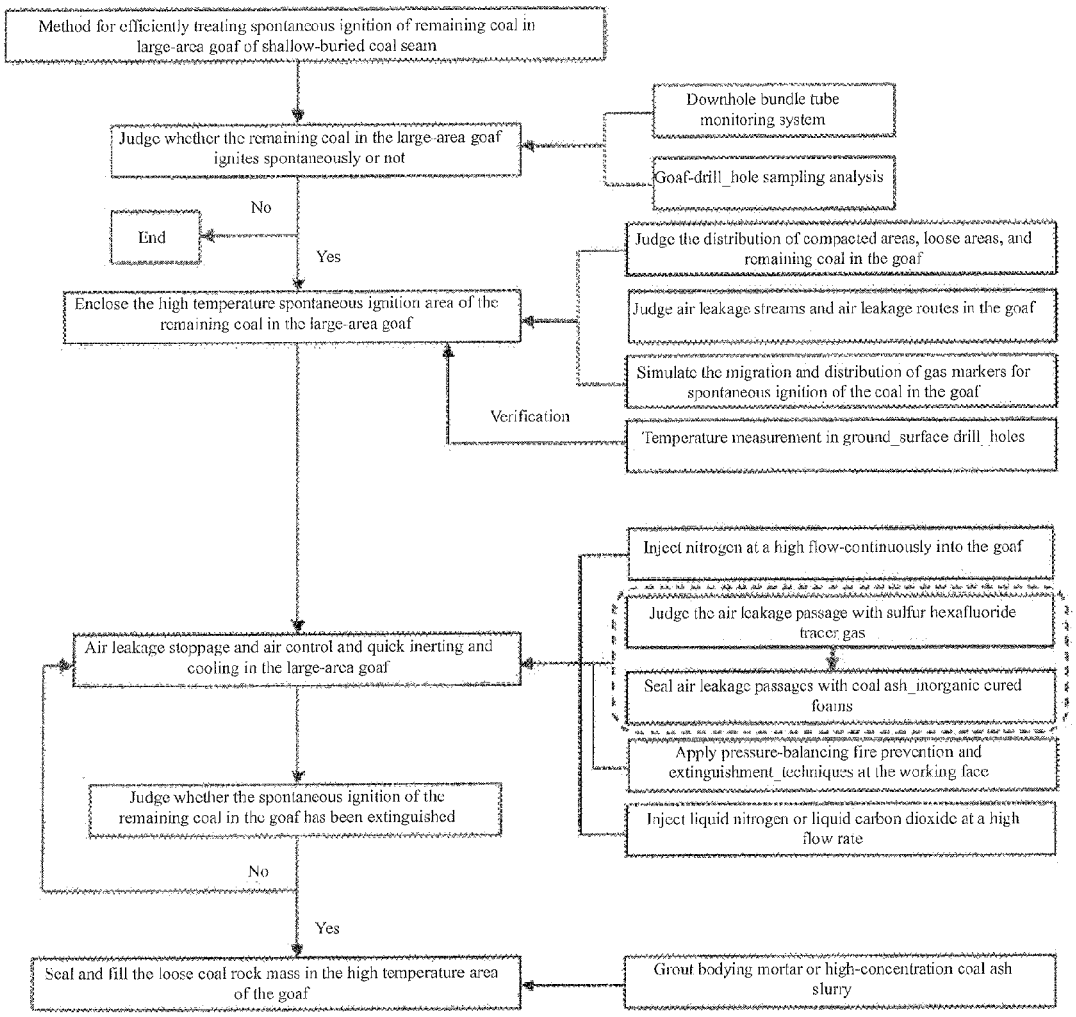
FIG. 1 is a flow chart of the method for efficiently treating spontaneous ignition of the remaining coal in a large-area goaf of a shallow-buried coal seam according to the present invention.

Hereunder the present invention will be further detailed in embodiments, with reference to the accompanying drawings.

A method for efficiently treating spontaneous ignition of remaining coal in a large-area goaf of a shallow-buried coal seam, comprising the following steps: pre-judging whether the remaining coal in the goaf ignites spontaneously; once it is found that the remaining coal in the goaf ignites spontaneously, first, enclosing the high-temperature spontaneous ignition area of the remaining coal in the goaf; then, injecting nitrogen continuously at a high flow into the large-area underground goaf to decrease the oxygen concentration in the goaf; next, using an air pressure-balancing fire prevention and extinguishment technique to reduce the air leakage into the goaf, and releasing sulfur hexafluoride tracer gas at the same time to conduct qualitative analysis on air leakage passages that communicate with the goaf and carrying out leaking stoppage for the air leakage passages; then, using ground surface fire extinguishing drill holes to carry out treatment and detection, i.e., injecting a fire extinguishing material to treat the spontaneous ignition of the coal in the goaf and utilizing effective drill holes to judge whether the spontaneous ignition of the coal in the goaf is extinguished or not; finally, grouting bodying mortar or high-concentration coal ash slurry into the high-temperature spontaneous ignition area of the coal and the drill holes.

The step of pre-judging whether the remaining coal in the goaf ignites spontaneously or not is implemented by detecting the gases in the goaf and the drill holes that communicate with the goaf in the downhole roadways with a downhole bundle tube monitoring system in conjunction with chromatographic analysis of gas samples taken manually with bladders; the drill holes are utilized as sampling drill holes, gas extraction drill holes, and water drainage drill holes; whether the remaining coal in the goaf ignites spontaneously is judged by the volumetric concentrations and concentration changes of gases markers for spontaneous ignition of coal, such as CO, $C_2H_4$, and $C_2H_2$, etc. If the volumetric concentration of CO is high and its concentration increases continuously and largely, and $C_2H_4$ gas appears at the same time, it indicates that the temperature of the spontaneously igniting coal in the goaf at least exceeds 85° C.; if $C_2H_2$ appears, it indicates that the temperature of the spontaneously igniting coal in the goaf at least exceeds 200° C.

The step of enclosing the high-temperature spontaneous ignition area of the remaining coal in the goaf comprises the following steps:

1. judging the distribution of compacted areas, loose areas, and remaining coal in the goaf, in consideration that the spontaneous ignition of coal mainly occurs in loose areas and places where a large quantity of remaining coal exists;
2. judging air leakage streams and air leakage stream routes in the downhole goaf;
3. carrying out simulation study on the rule of migration and distribution of gas markers for spontaneous ignition of coal in the goaf, and enclosing the high-temperature spontaneous ignition area of the remaining coal in the goaf preliminarily in conjunction with steps 1 and 2;
4. drilling temperature measurement drill holes having a diameter of 108 mm from the ground surface after the high-temperature spontaneous ignition area of the remaining coal in the goaf is enclosed preliminarily, utilizing the drill holes to detect and verify the temperatures in the areas adjacent to the ends of the drill holes, and finally determining the approximate scope of spontaneous ignition of the remaining coal in the goaf.

The step of injecting nitrogen into the large-area goaf is implemented by injecting nitrogen at a high flow rate not lower than 2,000 $m^3$/h into the downhole goaf.

The step of using a pressure-balancing fire prevention and extinguishment technique to reduce air leakage into the goaf is implemented by mounting a local ventilator and a damper in a return airway at the working face to increase the resistance in the return airway and decrease the pressure difference between an intake airway and the return airway, and thereby reduce the air leakage from the working face to the goaf. The pressure difference between the working face and the goaf is adjusted according to the situation of spontaneous ignition of the coal, under a principle of ensuring a safe working environment.

The step of releasing sulfur hexafluoride tracer gas for qualitative analysis of air leakage passages that communicate with the goaf and carrying out leakage stoppage is implemented by: first, selecting deep and wide ground surface fissures and releasing sulfur hexafluoride tracer gas into those fissures; then, receiving sulfur hexafluoride at top and bottom corners of the downhole working face and analyzing the receiving time and concentration of sulfur hexafluoride; next, carrying out qualitative analysis on the major ground surface fissures and air leakage passages that communicate with the goaf according to the releasing sites and the receiving result; finally, sealing the air leakage passages with coal ash inorganic cured foams to stop the air leakage through the major fissures.

The step of adopting ground surface fire-extinguishing drill holes for detection and treatment is implemented by: forming fire-extinguishing drill holes by a drilling machine drilling from the ground surface to the goaf in the coal seam; utilizing the drilled fire-extinguishing drill holes as a temperature measurement drill holes first to carry out temperature measurement; utilizing the drilled fire-extinguishing drill holes as gas sampling drill holes then to carry out gas constitution and concentration analysis; next, judging the situation of spontaneous ignition of the remaining coal adjacent to the ends of the drill holes according to the measured temperature and gas constitution in the drill holes; wherein, the surface fire-extinguishing drill holes have a diameter of 108 mm, and the spacing between the drill holes is 10~15 m; after the fire-extinguishing drill holes are drilled, the fire-extinguishing material is injected into the drill holes sequentially, starting from the peripheral drill holes, and then turning to the drill holes in the central high-temperature area gradually; liquid nitrogen or liquid carbon dioxide is injected at a high flow through the ground surface fire-extinguishing drill holes into the high-temperature spontaneous ignition area in the goaf for rapid inerting and cooling; specifically, 10~30 tons of liquid nitrogen or liquid carbon dioxide is injected into each drill hole at each time, and then stop grouting and turn to grout adjacent drill holes; the grouting is repeated after a period, wherein, the time interval between grouting cycles is 24 h.

The step of utilizing effective drill holes to judge whether the spontaneous ignition of the remaining coal in the goaf is extinguished or not is implemented by: after 3~5 days from the date when the grouting of the fire-extinguishing material into the fire-extinguishing drill holes is stopped, carrying out sampling in drill holes in the goaf that communicate with downhole roadways and the fire-extinguishing drill holes by a downhole bundle tube monitoring system; and analyzing the gas markers for spontaneous ignition of the coal in the goaf, such as CO, $C_2H_4$ and $C_2H_2$, etc., making a judgment comprehensively in conjunction with the temperature measurement in the fire-extinguishing drill holes; if the spontaneous ignition is judged as having been extinguished, finally grouting bodying mortar or high-concentration coal ash slurry into the high-temperature spontaneous ignition area of the remaining coal through the fire-extinguishing drill holes, wherein, the mass ratio of ash to water in the coal ash grout is greater than 1:2.

In the sampling analysis of the gasses in the goaf, if the concentration of $O_2$ is stably below 7%, the concentration of CO is stably below 50~100 ppm, no $C_2H_4$ or $C_2H_2$ appears, and the temperatures in the drill holes are normal temperature, it indicates that the spontaneous ignition of the coal in the goaf has been extinguished.

Embodiment 1 the method will be described in an example of an accident of spontaneous ignition of the remaining coal in a large-area goaf of a shallow-buried coal seam in a coal mine in the Western China region. The coal seam being mined in the coal mine is coal seam 22 (working face 22305), the upper seam is goaf 12306, and the average spacing between coal seam 12 and coal seam 22 is about 43 m. The burial depth of coal seam 12 is 96-233 m, the average thickness is 5.4 m, the remaining top coal have a thickness of 2.9 m, and remains in a broken state in the goaf. The recovery mining of the coal seam 12 started in 1999 and ended in 2007. Six fully-mechanized mining faces are arranged in the panel, and all of the fully-mechanized mining faces are arranged along the coal seam. The coal seams 12 and 22 belong to coal seams that have a tendency of spontaneous ignition, and the natural ignition period is one month.

The coal seam 12 is buried under a shallow depth, has smaller spacing to adjacent coal seams, and is mined by strip mining along a main roadway, without panel roadway; the working face has long crossheading, large width, great mining height, and wide goaf range; there are 12 goafs nearby, connected into one large-area goaf, with area as large as 19.7 million $m^2$. The stope pressure is high, and there are many ground surface collapses and fissures, many continuous mining double tunneling coupling roadways (more than 100 on each side), a lot of poor ventilation facilities and air leakage passage; in addition, some working faces have exposed ground surface bedrocks and are at the verge of valleys, and have severe surface fissures.

In view that the cut hole of the working face 12306 is low lying and it is detected that there is a large amount of accumulated water therein, drainage drill holes are drilled at the working face 22305 air return way to drain off the accumulated water in advance, in order to prevent gushing of the accumulated water in the overlaying goaf into the working face 22305 in the mining process, and all the drill holes are drilled at 42° average tilt angle into the goaf 12306, the drilling depth is 56~69 m, and altogether 75 drill holes are drilled out, and 460,000 $m^3$ water is drained off.

High-concentration of carbon monoxide is detected in the goaf 12306 utilizing a bundle tube monitoring system arranged along the air-tight wall of a downhole coupling roadway and the drainage drill hole on the overlaying goaf of the air return way 100 coupling roadway at the working face 22305, in conjunction with chromatographic analysis of gas samples taken manually with bladders. The highest concentration detected in the goaf is higher than 1,000 ppm. In the next few days, the detection result indicates that the gas samples contain ethane and ethylene; thus, it is concluded that the remaining coal in the overlaying goaf is oxidized more severely, and the temperature of the spontaneously igniting coal in the goaf at least exceeds 85° C. In the following continuous sampling analysis, it is found that the concentrations of carbon monoxide, ethane and ethylene are increasing continuously and largely, specifically, the concentration of carbon monoxide is 3,000~5,000 ppm, the concentration of ethane is 50~110 ppm, and the concentration of ethylene is 7~17 ppm; those values indicate that the remaining coal in the goaf is oxidized more quickly. In the sample analysis on July 15, it is found that the concentration of carbon monoxide is as high as 54,886 ppm and accompanying appearance of acetylene, which indicates that the temperature of the spontaneously igniting coal in the goaf at least exceeds 200° C. and severe natural ignition of the remaining coal in the goaf 12306 has happened.

Top coal having a thickness of about 3 m is reserved in the recovery mining process at the working face 12306, and a large quantity of broken remaining coal exist in the goaf. Owing to the fact that the overlying bedrock above the coal seam 12 is thick, the overall compactness in the goaf 12306 is good, except at the cut hole and the crossheading location; in addition, in view that the spontaneous ignition of coal mostly occurs in loose areas and places where a large quantity of remaining coal exists, it is speculated that the spontaneous ignition of the coal may happen near the cut hole and the crossheading location in the goaf 12306. To prevent toxic and harmful downhole gasses from gushing to the working face, a U-shaped positive-pressure ventilation scheme is used at the working face 22305, the air volume at the working face reaches 2100 $m^3$/min. In view that the cut hole at the working face 12306 is low lying and there is a lot of accumulated water, 75 drainage drill holes have been drilled and drainage destroys the water-vapor balance in the goaf, resulting in "water-vapor" displacement; in addition, since the spacing between the coal seams is very small, a lot of fissures are formed, and the air leakage near the cut hole at the working face 12306 largely increases. Moreover, according to the analysis made with the bundle tube monitoring system arranged along the air-tight wall of goaf 12306 and the test and analysis of gas samples taken in the drainage drill holes, it is found that the concentrations of gas markers for spontaneous ignition of coal are higher at positions closer to the cut hole at the working face 12306, and conform to the rule of migration and distribution of gas markers for spontaneous ignition of the coal (near the cut hole at the working face 12306) in the goaf. Thus, a high-temperature spontaneous ignition area of remaining coal in the goaf 12306 is preliminarily enclosed near the cut hole of the working face 12306.

11 temperature measurement drill holes having a diameter of 108 mm are drilled at 10-15 m spacing between the drill holes on peripheral of the ground surface around the cut hole of the working face 12306, the goaf caving situation is judged according to the drill holes. The goaf has a larger space near the two roadways, and is essentially caved at the middle part of the working face. Temperature measurement is carried out immediately after the drill holes are constructed; the temperatures in three drill holes on the surface are higher, and are 27.5° C., 38° C. and 49° C. respectively; in addition, after the drill holes are drilled, smoke and hot gasses gush out from the drill holes. According to the ground surface and downhole drilling result, high-temperature spontaneous ignition areas of the remaining coal in the goaf 12306 are essentially enclosed around the 3 drill holes near the cut hole of the working face 12306, where the temperature is higher.

After the high-temperature area is enclosed, nitrogen is injected at a high flow into the high-temperature spontaneous ignition area of the remaining coal in the goaf, so as to decrease the oxygen concentration in the goaf, attain the purpose of inerting goaf, and control the development of the spontaneous ignition of the remaining coal. 4 nitrogen injection drill holes are drilled into the air return ways at the working face 22305, nitrogen is injected continuously at a high flow rate not lower than 2,000 $m^3$/h into the goaf 12306 with DM-1000 mobile nitrogen injectors operating at the same time, wherein, the operation time of each nitrogen injector is not shorter than 20 h/d. Accumulative total 6.88-million $m^3$ nitrogen is injected from July 5 to August 16.

Then, a U-shaped pressure-balancing ventilation system is applied to the working face 22305, mainly by mounting a local ventilator and a damper in the return airway at the working face 22305 to increase the resistance in the return airway and decrease the pressure difference between the air intake airway and the return airway, and thereby reduce positive-pressure air leakage from the working face to the goaf. Two 75 KW auxiliary fans are selected for the pressure-balancing ventilator and are configured in a primary/standby configuration. In the early stage, the air supply rate is 1,800 $m^3$/min., the air volume, air pressure, and pressure difference in the positive pressure area are measured every day, so that the pressure difference between air intake and air return at the working face 22305 is controlled within 1,000 Pa, and local adjustment is made timely once there is large change of pressure difference, to ensure pressure balance between the goaf and the working face, and reduce air leakage into the goaf or large gush of toxic and harmful gasses (e.g., carbon monoxide) from the goaf.

Meanwhile, deep and wide surface fissures are selected in the ground surface area on and near the high-temperature spontaneous ignition area of the remaining coal in the goaf, 20 kg sulfur hexafluoride is released simultaneously through hoses having a diameter of 1-inch at those fissures, and the sulfur hexafluoride tracer gas is received at top and bottom corners of the working face 22305, and the receiving time and concentration of the received sulfur hexafluoride tracer gas is logged; then, major ground surface fissures and air leakage passages that communicate with the goaf are analyzed comprehensively according to the releasing site and the receiving result. Through 36 h continuous sampling and chromatographic analysis at 30 min. sampling interval, it is found that there are obvious air leakage passages around the goaf 12306 and in the ground surface fissures. In view that the goaf 12306 has exposed surface bedrocks and numerous ravines and gullies, the sealing work is very difficult. First, the major fissures are filled and sealed with coal ash inorganic cured foams; then, secondary sealing and back-filling is carried out by manual back-filling and mechanical back-filling in combination; in addition, the air leakage passages are sealed with coal ash inorganic cured foams at the top and bottom corners of the working face 22305 and the air-tight walls of the coupling roadways.

Fire-extinguishing drill holes are drilled with a drilling machine from the ground surface to the high temperature area of the goaf 12306; the fire-extinguishing drill holes are used as temperature measurement drill holes first to detect and enclose the high temperature area of the goaf. Before a fire-extinguishing material is injected through the surface fire-extinguishing drill holes, the drill holes are used as temperature measurement drill holes and gas sampling drill holes again to detect the gas constitution, concentration, and temperature near the ends of the drill holes. The surface fire-extinguishing drill holes have a diameter of 108 mm, and the spacing between the drill holes is 10~15 m. After the fire-extinguishing drill holes are drilled, the fire-extinguishing material is injected into the drill holes sequentially, starting from the peripheral drill holes first, and then turning to the drill holes in the central high-temperature area gradually. The fire-extinguishing material is injected from 22:00 on the day to 10:00 on the next day, in view that the atmospheric pressure near the ground surface is higher and the gas leakage from the goaf is less in that period. Liquid nitrogen or liquid carbon dioxide is injected at a high flow through the surface fire-extinguishing drill holes into the high-temperature spontaneous ignition area in the goaf for rapid inerting and cooling; specifically, 10~30 tons of liquid nitrogen or liquid carbon dioxide is injected into each drill hole at each time, and then stop grouting and turn to grout adjacent drill holes. The grouting is repeated after a period, wherein, the time interval between grouting cycles is 24 h. The liquid nitrogen is gasified quickly at normal temperature under normal pressure, and spreads quickly in the burning area and fills the space; as a result, the oxygen concentration in the burning area is decreased rapidly and the fire is extinguished owing to oxygen depletion. Nitrogen not only has fire inerting capability and explosion inhibiting capability, it absorbs a lot of heat in the transition process from liquid state to gas state; thus, the temperature in the burning area can be decreased. To improve the injection speed of liquid nitrogen and liquid carbon dioxide and increase the discharge speed of toxic and harmful gasses in the goaf, 5 drill holes are further constructed in the last stage. Altogether 7,200 tons of liquid nitrogen and 1,120 tons of liquid carbon dioxide are injected through the ground surface fire-extinguishing drill holes from July 5 to August 16.

Whether the spontaneous ignition of the remaining coal in the goaf has been extinguished must be judged after a period from the time when the fire-extinguishing material is injected through the ground surface fire-extinguishing drill holes. Specifically, after 3~5 days from the date when the injection of the fire-extinguishing material through the fire-extinguishing drill holes is stopped, sampling is carried out utilizing the downhole bundle tube monitoring system on drill holes that communicates with the goaf in the downhole roadways (drainage drill holes), and fire-extinguishing drill holes, the oxygen concentration and the changes of concentrations and constitutions of gas markers (carbon monoxide and acetylene, etc.) for spontaneous ignition of coal are analyzed, and a comprehensive judgment is made with reference to the temperature measurement in the fire-extinguishing drill holes. The gasses in the goaf are sampled and analyzed. If the oxygen concentration is stably below 7%, the carbon monoxide concentration is stably below 50~100 ppm, no acetylene or ethylene gas exists, and the temperatures in the drill holes are normal temperature, it indicates that the spontaneous ignition of the coal in the goaf has been extinguished.

Figure 2:
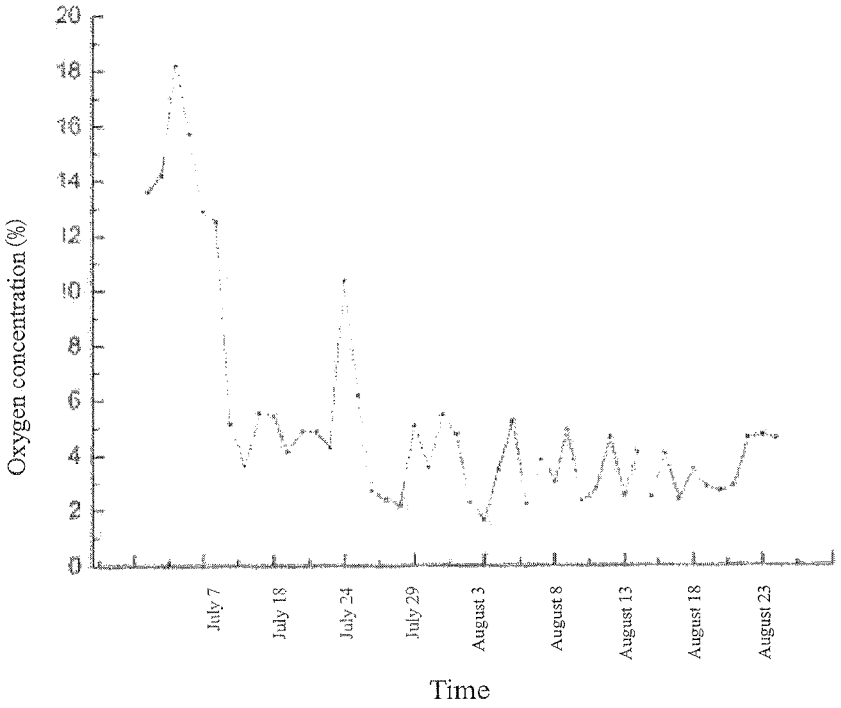
FIG. 2 is a diagram illustrating the oxygen concentration after treatment of the high-temperature spontaneous ignition area of the remaining coal in the goaf.
Figure 3:
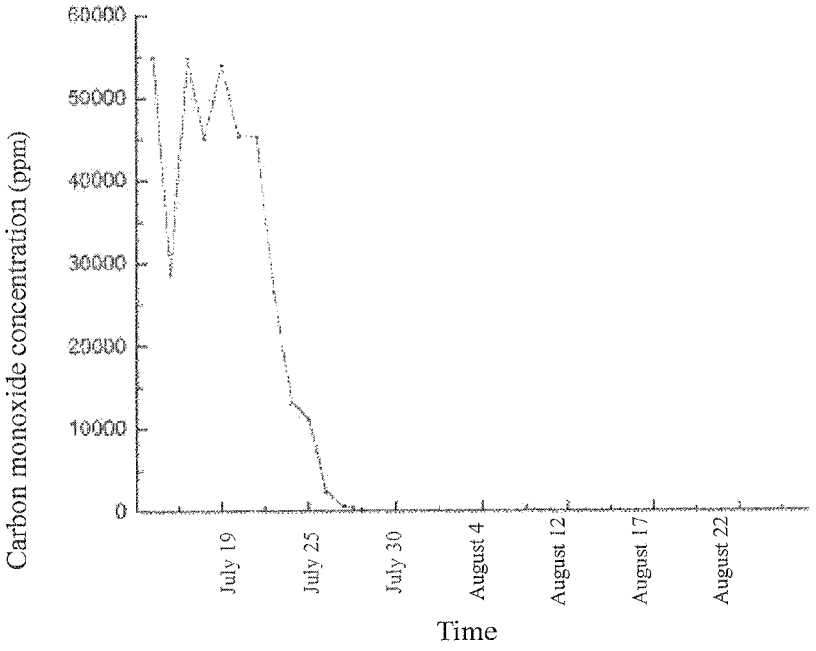
FIG. 3 is a diagram illustrating the carbon monoxide concentration after treatment of the high-temperature spontaneous ignition area of the remaining coal in the goaf.

As shown in FIGS. 2 and 3, in the treatment period that lasts for 50 days, the high temperature area in the goaf 12306 is effectively controlled, and the concentrations of harmful gasses in the goaf are decreased continuously. According to the result of detection carried out with the bundle tube monitoring system and in the drill holes, the oxygen concentration in the goaf 12306 is kept below 5%, the carbon monoxide concentration in the goaf 12306 is decreased from 54,886 ppm to 50 pm, and no ethylene or acetylene gas appears; measured in the temperature measurement drill holes, the temperature in the high temperature area of the goaf is at 20° C. stably. The above monitoring and detection results indicate that the spontaneous ignition of the coal in the high temperature area of the goaf 12306 in the coal mine has been extinguished satisfactorily.

To guarantee the fire-extinguishing result and expedite the normal recovery mining work at the working face, after the spontaneous ignition of the remaining coal in the goaf is extinguished, 11,514 tons of high-concentration coal ash slurry is grouted through the fire-extinguishing drill holes into the high-temperature spontaneous ignition area of the remaining coal finally. Thus, a thorough sealing and filling effect is attained.

The invention claimed is:

1. A method for efficiently treating spontaneous ignition of remaining coal in a large-area goaf of a shallow-buried coal seam, comprising the steps of:

pre judging whether the remaining coal in the goaf ignites spontaneously;

once it is found that the remaining coal in the goaf ignites spontaneously, first, enclosing the high-temperature spontaneous ignition area of the remaining coal in the goaf;

then, injecting nitrogen continuously at a high flow into the large-area underground goaf to decrease the oxygen concentration in the goaf;

next, using an air pressure-balancing fire prevention and extinguishment technique to reduce air leakage into the goaf, and releasing sulfur hexafluoride tracer gas at the same time to conduct qualitative analysis on air leakage passages that communicate with the goaf and carrying out leaking stoppage for the air leakage passages;

drilling ground surface fire extinguishing drill holes, then, using the ground surface fire extinguishing drill holes to carry out treatment and detection, injecting a fire extinguishing material to treat the spontaneous ignition of the coal in the goaf and utilizing the drill holes to judge whether the spontaneous ignition of the coal in the goaf is extinguished or not; and, finally, grouting bodying mortar and high-concentration coal ash slurry into the high-temperature spontaneous ignition area of the coal and the drill holes.

2. The method for efficiently treating spontaneous ignition of remaining coal in a large-area goaf of a shallow-buried coal seam according to claim 1, wherein:

the step of pre-judging whether the remaining coal in the goaf ignites spontaneously or not is implemented by detecting gasses in the goaf and the drill holes that communicate with the goaf in downhole roadways using a downhole bundle tube monitoring system in conjunction with chromatographic analysis of gas samples taken manually with bladders;

utilizing the drill holes as sampling drill holes, gas extraction drill holes, and water drainage drill holes; and, whether the remaining coal in the goaf ignites spontaneously is pre-judged by the volumetric concentrations and concentration changes of gaseous markers for spontaneous ignition of coal.

3. The method for efficiently treating spontaneous ignition of remaining coal in a large-area goaf of a shallow-buried coal seam according to claim 1, wherein, the step of enclosing the high-temperature spontaneous ignition area of the remaining coal in the goaf comprises the following steps:

step 1: judging the distribution of compacted areas, loose areas, and remaining coal in the goaf, in consideration that the spontaneous ignition of coal mainly occurs in loose areas and places where a large quantity of remaining coal exists;

step 2: judging air leakage streams and air leakage stream routes in the downhole goaf;

step 3: carrying out a simulation study on the rule of migration and distribution of gas markers for spontaneous ignition of coal in the goaf, and quickly enclosing the high-temperature spontaneous ignition area of the remaining coal in the goaf preliminarily in conjunction with the steps 1 and 2; and step 4: drilling temperature measurement drill holes from the ground surface after the high-temperature spontaneous ignition area of the remaining coal in the goaf is enclosed preliminarily, utilizing the drill holes to detect and verify the temperatures in the areas adjacent to the ends of the drill holes, and determining the approximate scope of spontaneous ignition of the remaining coal in the goaf.

4. The method for efficiently treating spontaneous ignition of remaining coal in a large-area goaf of a shallow-buried coal seam according to claim 3, wherein the temperature measurement drill holes have a diameter of 108 mm.

5. The method for efficiently treating spontaneous ignition of remaining coal in a large-area goaf of a shallow-buried coal seam according to claim 1, wherein, the nitrogen injection into the large-area goaf is implemented by injecting nitrogen at a high flow rate not lower than 2,000 $m^3/h$ into the downhole goaf.

6. The method for efficiently treating spontaneous ignition of remaining coal in a large-area goaf of a shallow-buried coal seam according to claim 1, wherein, the step of using an air pressure-balancing fire prevention and extinguishment technique is implemented by mounting a local ventilator and a damper in a return airway at the downhole working face to increase the resistance in the return airway and decrease a pressure difference between an airway intake and the airway return, and thereby reduce air leakage from the working face to the goaf.

7. The method for efficiently treating spontaneous ignition of remaining coal in a large-area goaf of a shallow-buried coal seam according to claim 1, wherein, the step of releasing sulfur hexafluoride tracer gas for qualitative analysis of air leakage passages that communicate with the goaf and carrying out leakage stoppage is implemented by:

first, selecting deep and wide ground surface fissures and releasing sulfur hexafluoride tracer gas into the selected fissures;

then, receiving sulfur hexafluoride at top and bottom corners of the downhole working face and analyzing the receiving time and concentration of sulfur hexafluoride;

next, carrying out qualitative analysis on the major surface fissures and air leakage passages that communicate with the goaf according to the releasing sites and the receiving result; and, finally, sealing the air leakage passages with coal ash inorganic cured foams to stop the air leakage through the major fissures.

8. The method for efficiently treating spontaneous ignition of remaining coal in a large-area goaf of a shallow-buried coal seam according to claim 1, wherein:

the step of drilling ground surface fire-extinguishing drill holes for detection and treatment is implemented by:

drilling fire-extinguishing drill holes with a drilling machine from the ground surface to the goaf in the coal seam;

utilizing the drilled fire-extinguishing drill holes as a temperature measurement drill holes first to carry out temperature measurement;

then, utilizing the drilled fire-extinguishing drill holes as gas sampling drill holes to carry out gas constitution and concentration analysis;

next, judging the situation of spontaneous ignition of the remaining coal adjacent to the ends of the drill holes according to the measured temperature and gas constitution in the drill holes;

wherein, the ground surface fire-extinguishing drill holes have a diameter of 108 mm, and the spacing between the drill holes is 10~15 m;

after the fire-extinguishing drill holes are drilled, the fire-extinguishing material is injected into the drill holes sequentially, starting from the peripheral drill holes first, and then turning to the drill holes in the central high-temperature area gradually;

liquid nitrogen or liquid carbon dioxide is injected at a high flow rate through the surface fire-extinguishing drill holes into the high-temperature spontaneous ignition area in the goaf for rapid inerting and cooling;

10~30 tons of liquid nitrogen or liquid carbon dioxide is injected into each drill hole at each time, and then stop grouting and turn to grout adjacent drill holes; and, the grouting is repeated after a period, wherein, the time interval between grouting cycles is 24 h.

9. The method for efficiently treating spontaneous ignition of remaining coal in a large-area goaf of a shallow-buried coal seam according to claim 1, wherein, the step of utilizing effective drill holes to judge whether the spontaneous ignition of the remaining coal in the goaf is extinguished or not is implemented by:

after 3~5 days from the date when the grouting of the fire-extinguishing material into the fire-extinguishing drill holes is stopped, carrying out sampling in drill holes communicate with the goaf in downhole roadways and the fire-extinguishing drill holes by using downhole bundle tube monitoring system;

analyzing gaseous markers for spontaneous ignition of the coal in the goaf, making a judgment comprehensively in conjunction with the temperature measurement in the fire-extinguishing drill holes; and, if the spontaneous ignition is judged as having been extinguished, finally grouting bodying mortar or high-concentration coal ash grout into the high-temperature spontaneous ignition area of the remaining coal through the fire-extinguishing drill holes, wherein, the mass ratio of ash to water in the coal ash grout is greater than 1:2.

10. The method for efficiently treating spontaneous ignition of remaining coal in a large-area goaf of a shallow-buried coal seam according to claim 9, wherein, in the sampling analysis of the gasses in the goaf, if a concentration level of $O_2$ is below 7% stably, a concentration level of CO is below 50~100 ppm stably, no levels of $C_2H_4$ and $C_2H_2$ appear, and the temperatures in the drill holes are normal temperature, such levels and temperature are an indication that the spontaneous ignition of the coal in the goaf has been extinguished.

11. The method for efficiently treating spontaneous ignition of remaining coal in a large-area goaf of a shallow-buried coal seam according to claim 9, wherein the gaseous markers are selected from $CO_2$, $C_2H_2$ and $C_2H_4$.

12. The method for efficiently treating spontaneous ignition of remaining coal in a large-area goaf of a shallow-buried coal seam according to claim 1, wherein the gaseous markers are selected from CO, $C_2H_2$ and $C_2H_4$.

* * * * *